United States Patent [19]

Wissmann et al.

[11] 4,364,362

[45] Dec. 21, 1982

[54] METERING AND DISTRIBUTION VALVE ASSEMBLY

[75] Inventors: Michael Wissmann, Gerlingen; Peter Stiefel, Ditzingen, both of Fed. Rep. of Germany

[73] Assignee: Robert Bosch GmbH, Stuttgart, Fed. Rep. of Germany

[21] Appl. No.: 227,867

[22] Filed: Jan. 23, 1981

[30] Foreign Application Priority Data

Jan. 24, 1980 [DE] Fed. Rep. of Germany ..... 3002458

[51] Int. Cl.[3] ..... F02M 39/00

[52] U.S. Cl. ..... 123/454; 123/455; 251/175; 251/190

[58] Field of Search ..... 123/455, 452, 453, 454; 251/175, 190

[56] References Cited

U.S. PATENT DOCUMENTS

| | | | |
|---|---|---|---|
| 3,115,329 | 12/1963 | Wing et al. | 251/175 |
| 3,784,330 | 1/1974 | Eheim et al. | 123/454 |
| 3,981,330 | 9/1976 | Watts | 251/175 |
| 4,075,995 | 2/1978 | Kramer | 123/455 |
| 4,227,501 | 10/1980 | Knapp et al. | 123/455 |
| 4,240,391 | 12/1980 | Nagase et al. | 123/455 |

FOREIGN PATENT DOCUMENTS

| | | | |
|---|---|---|---|
| 2329667 | 1/1975 | Fed. Rep. of Germany | 123/454 |
| 2344301 | 3/1975 | Fed. Rep. of Germany | 123/454 |

*Primary Examiner*—Ira S. Lazarus
*Assistant Examiner*—Magdalen Moy
*Attorney, Agent, or Firm*—Edwin E. Greigg

[57] ABSTRACT

A metering and distribution valve assembly is proposed for a fuel injection system of an internal combustion engine. The metering and distribution valve assembly includes a control slide having a head 68 and a control edge and a slotted sleeve with at least two control slits. The control edge opens the control slits to a greater or lesser degree in accordance with the relative motion between the control slide and the control slits in the slotted sleeve. An end face of the control slide adjacent to the control edge is exposed to a control pressure which is lower than the system pressure engaging the control edge. The pressure drop at the circumference of the control slide head formed between the control edge and the end face is capable of being influenced in such a manner that the control slide head rests unilaterally on the slotted sleeve at least during a portion of the displacement movement. As a result, better metering precision is obtained. The unilateral resting of the control slide head on one side of the slide bore can be effected either by the application of fuel at system pressure at the aperture or by the application of fuel at control pressure at the longitudinal groove.

6 Claims, 4 Drawing Figures

METERING AND DISTRIBUTION VALVE ASSEMBLY

BACKGROUND OF THE INVENTION

The invention is based on a metering and distribution valve assembly for a fuel injection system of an internal combustion engine as described herein and finally claimed. A metering and distribution valve assembly is already known but as a result of play between the control slide and the slotted sleeve, a continuous change takes place in the radial position of the control slide. As a result of this change, the fuel quantities metered at the individual control slits vary in an undesirable manner.

OBJECT AND SUMMARY OF THE INVENTION

The metering and distribution valve assembly according to the invention has the advantage over the prior art that at least for a portion of the sliding movement of the control slide, a precise positioning of the control slide relative to the slotted sleeve is maintained, so that various fuel quantities metered at the individual control slits are precise.

As a result of the characteristics disclosed and claimed, advantageous modifications of and improvements to the metering and distribution valve assembly disclosed can be attained.

The invention will be better understood and further objects and advantages thereof will become more apparent from the ensuing detailed description of preferred exemplary embodiments taken in conjunction with the drawings.

DESCRIPTION OF THE PREFERRED EMBODIMENT

Figure 1:
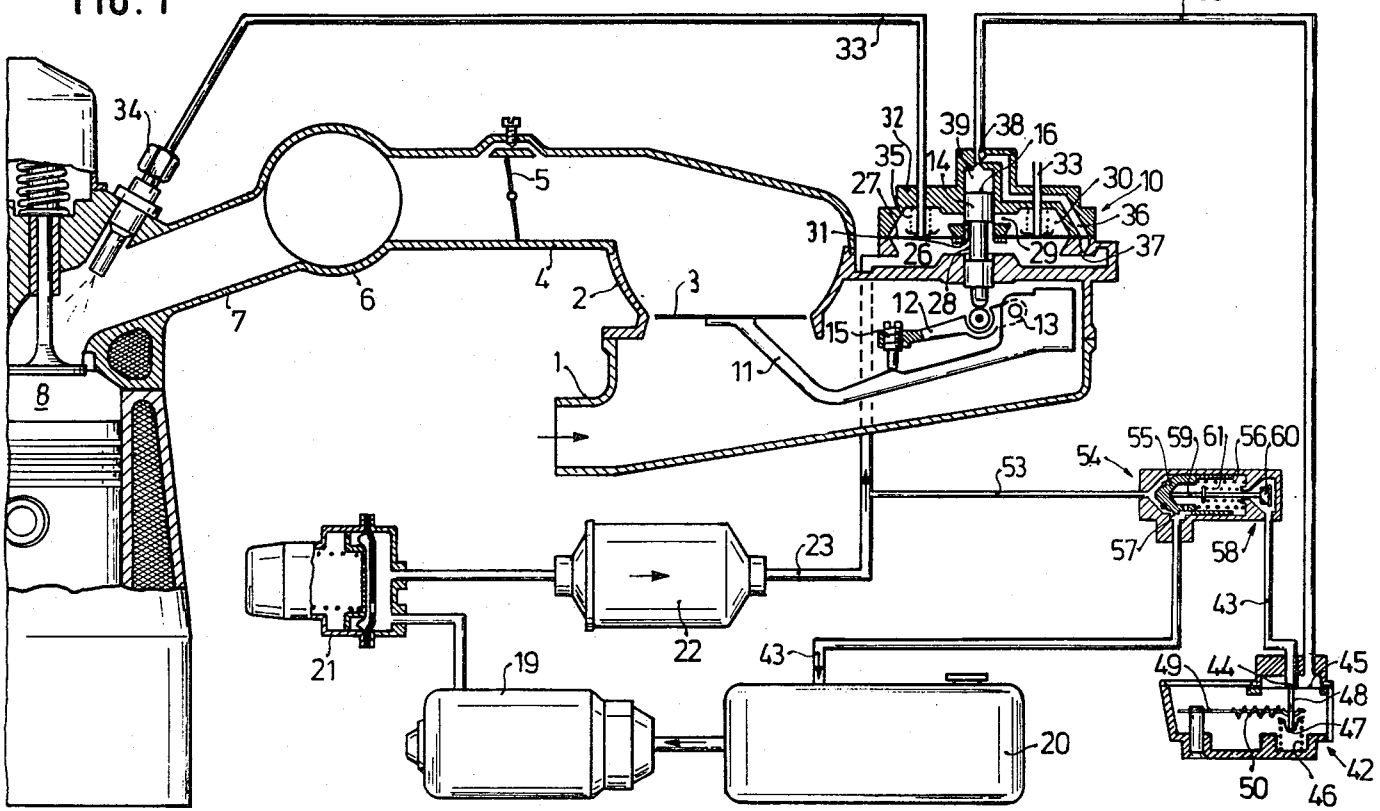
FIG. 1 shows schematically, in both cross section and elevation the structural components of a fuel injection system having a metering and distribution valve assembly.

In FIG. 1, a fuel injection system is shown which includes an intake manifold 1 having a conical section 2 which contains an air flow rate member 3, beyond which there is located an intake tube region 4 containing an arbitrarily settable throttle valve 5. Aspirated air flows through the intake tube in the direction of the arrow to a manifold 6, from which it is directed via individual intake tube regions 7 to one or more cylinders 8 of an internal combustion engine.

In the present case, the air flow rate member 3 is a baffle plate disposed transversely with respect to the direction of air flow and capable of displacement within the conical region 2 of the intake tube as an approximately linear function of the air flow rate through the tube. The air pressure between the air flow rate member 3 and the throttle valve 5 will be constant, provided that the restoring force acting on the air flow rate member 3 is constant and that the air pressure ahead of the member 3 is also constant. The air flow rate member 3 controls the opening of a metering and distribution valve assembly 10. The motion of the air flow rate member 3 is transmitted by an operating lever 11, which is pivoted on the same shaft as a correction lever 12 and which actuates the control slide 14, which is the movable member of the metering and distribution valve assembly 10. A mixture control screw 15 permits an adjustment of the desired fuel-air mixture. The end face 16 of the control slide 14 remote from the lever 11 experiences the pressure of a control fluid, which is exerted upon the air flow rate member 3 and acts as a return force in opposition to the force of the flowing air.

Fuel is supplied by an electric fuel pump 19, which aspirates fuel from a fuel tank 20 and delivers it through a storage container 21, a filter 22 and a fuel line 23 to the fuel metering and distribution assembly 10.

The fuel supply line 23 splits into several branches which lead to chambers 26 of the fuel valve assembly 10. One side of a diaphragm 27 in each chamber is affected by fuel pressure. The chambers 26 also communicate with an annular groove 28 of the control slide 14. Depending on the axial position of the control slide 14, a control edge 31 defining the annular groove 28 on one side opens control slits 29 to varying degrees, permitting fuel to flow into chambers 30 which are divided from the chambers 26 by the diaphragm 27. From the chambers 30, fuel flows through the injection channels 33 to the individual injection valves 34, which are located in the vicinity of the engine cylinders 8 in the intake tube region 7. The diaphragm 27 is the movable valve member of a flat seat valve which is held open by a spring 35 whenever the fuel injection system is not operating. The diaphragm boxes, defined in each case by a chamber 26 and a chamber 30, insure that the pressure drop at the metering valve 28, 29, 31 is substantially constant, independently of the fuel quantity metered at the metering valve 28, 29, 31 and flowing to the injection valves 34. This insures that the metered-out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle opening 38 with a pressure chamber 39 which is provided in the valve housing 32 and into which one end face 16 of the control slide 14 protrudes.

The control pressure line 36 contains a control pressure valve 42, which permits control fluid to return to the fuel tank 20 via a return line 43 without pressure. The control pressure valve 42 permits changing the pressure which produces the restoring force during the warm-up of the engine in accordance with time and temperature. The control pressure valve 42 is a flat-seat valve having a fixed control valve seat 44 and a diaphragm 45, which is urged in the closing direction by a spring 46. The spring 46 acts via a spring support 47 and a transmission pin 48 upon the diaphragm 45. When the engine temperature is below the normal operating temperature, a first bimetallic spring 49 acts in opposition to the force of the spring 46. The bimetallic spring 49 carries an electric heater 50, the operation of which after starting causes a diminution of the force of the bimetallic spring 49 on the spring 46, and by this means the control pressure in the control pressure line 36 increases.

A line 53 branches off from the fuel supply line 23 and a system pressure valve 54 is disposed in the line 53. By means of this system pressure valve 54, a constant fuel pressure (system pressure) is maintained upstream of the fuel metering valve 28, 29, 31. The system pressure valve 54 shown in the drawing by way of example has a regulating piston 55, which can be displaced by the fuel pressure in the line 53 counter to the force of a regulating spring 56, so that fuel can flow out of the line 53 via a regulating edge 57 into the return flow line 43 and back to the fuel tank 20. A blocking valve 58 disposed directly downstream of the pressure control valve 42 in the return flow line 43 can simultaneously be opened by the regulating piston 55 as it opens. To this end the regulating piston 55, as it opens and with the engine in operation, engages an actuation pin 59, which displaces the movable valve element 60 in the opening direction, counter to the force of a blocking spring 61. If the engine is shut off, then no further fuel supply on the part of the electric fuel pump 19 takes place, and the system pressure valve 54 closes. At the same time, the blocking spring 61 which engages the actuation pin 59 displaces the movable valve element 60 of the blocking valve 58 into the closed position, so that leakage of fuel out of the control pressure line 36 by way of the pressure control valve 42 is prevented, and the fuel injection system remains filled with fuel and is ready to be started once again.

Figure 2:
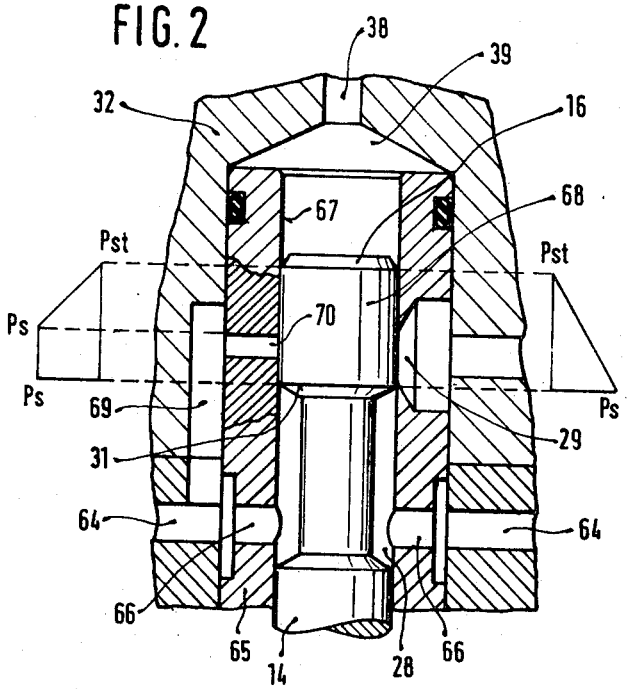
FIG. 2 illustrates an enlarged cross-sectional view of the metering and distribution valve assembly shown in FIG. 1.
Figure 3:
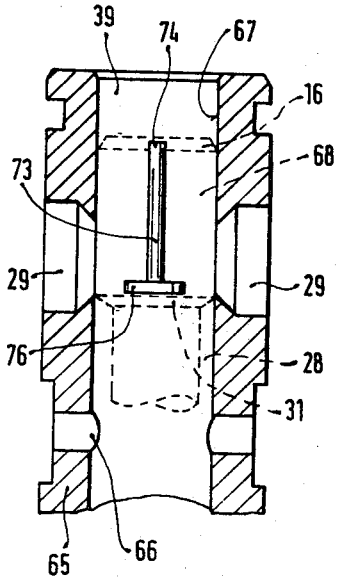
FIG. 3 illustrates a cross-sectional view of a modification of the metering and distribution valve assembly shown in FIG. 2.
Figure 4:
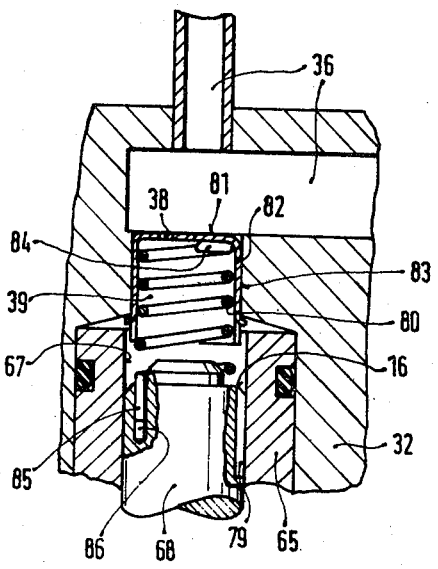
FIG. 4 illustrates a cross-sectional view of another modification of the metering and distribution valve assembly shown in FIG. 2.

In FIGS. 2–4, portions of metering and distribution valve assemblies are shown on a different scale and in greater detail. As is shown in FIG. 2, the control slide 14 slides within a slotted sleeve 65, in which control slits 29 are provided for guiding the control slide within the valve housing 32. The slotted sleeve 65 is provided with channels 66, which communicate via channels 64 in the valve housing 32 with the chambers 26 shown in FIG. 1. The control slide 14 slides in a slide bore 67 of the slotted sleeve 65 with sufficient spacing so as to assure an easy displacement movement on the part of the control slide 14. The spacing between the glide bore 67 and the circumference of a control slide head 68 formed between the end face 16 and the control edge 31 of the control valve produces a pressure drop, with the system pressure $p_S$ prevailing at the control edge 31 and the lower control pressure $P_{St}$ prevailing at the end face 16, as is indicated in the pressure diagram as indicated on the right-hand side of FIG. 2. Because this pressure drop has a symmetrical course over the circumference of the control slide head 68 as a whole, the control slide 14 is guided in the radial direction substantially without force. However, if there is some interruption in this symmetrical pressure distribution, the control slide 14 will rest on one side of the slide bore 67 in an indefinite manner, and it is possible for there to be error in the pressure measurement at the control slits 29. Such inexactness is particularly noticeable when the fuel quantities measured at the control slits 29 are small. Now in accordance with the invention, it is intended to influence the pressure drop at the circumference of the control slide head 68 in such a manner that at least during a portion of the displacement movement of the control slide 14, the control slide 14 will rest definitely on one side of the slotted sleeve 65. This is effected, in the exemplary embodiment of FIG. 2, by means of the communication of a longitudinal channel 69 with the channel 64; the longitudinal channel 69 further communicates with an aperture 70 penetrating the slotted sleeve 65, which is provided at the same level as and between two control slits 29, so that the system pressure $p_S$ prevailing in the channel 64 can communicate with one side of the circumference of the control slide head 68 via the aperture 70. As indicated in the pressure diagram shown on the left-hand side of FIG. 2, the result is a pressure drop having an altered course, because the system pressure $p_S$ already prevails on the upper edge of the aperture 70 and thus the pressure force exerted on the control slide head 68 on the side where the aperture 70 is located is greater, and this causes the control slide head 68 to come to rest on the side of the slide bore 67 which is remote from the aperture 70. This definite unilateral resting of the control slide head 68 in the slide bore 67 assures a uniform metering precision at all the control slits 29. The axial position of the aperture 70 may be selected such that the aperture 70 is overlapped by the control edge 31 after a predetermined opening movement on the part of the control slide 14 into the pressure chamber 39. As a result, the pressure drop prevailing over the circumference of the control slide head 68 is again embodied as symmetrical, and the control slide head 68 no longer rests unilaterally on the one side of slide bore 67.

In FIG. 3, the slotted sleeve 65 is shown in part, with the control slide head 68 indicated within the slide bore 67 by broken lines. A longitudinal groove 73 is provided in the wall of the slide bore 67 between two control slits 29, and the end 74 of this groove 73 oriented toward the pressure chamber 39 is opened toward the pressure chamber 39 so long as the control slide head 68 completely overlaps, or in other words closes, the control slits 29. The end 75 of the longitudinal groove 73 oriented toward the control edge 31 merges with a transverse groove 76, which is entirely overlapped by the control slide head 68 when the valve is in the closed position. This transverse groove 74 is intended to be opened by the control edge 31 toward the side of the system pressure $p_S$ only when there is a small opening movement on the part of the control slide head 68 into the pressure chamber 39; and at this time, the end face 16 is also intended to overlap the upper end 74 of the longitudinal groove 73 and thus seal it off from the pressure chamber 39. As a result, it is assured that until a small opening movement is attained the control pressure $p_S$ will prevail in the transverse groove 76, via the longitudinal groove 73, so that a lower pressure force is exerted upon the control slide head 68 on the side of the longitudinal groove 73 of the slide bore 67, and during an opening movement the control slide head 68 accordingly rests unilaterally on this side, until the control edge 31 opens the transverse groove 76 toward the side of the system pressure $p_S$.

In the exemplary embodiment shown in FIG. 4, a longitudinal groove 79 is provided in the control slide head 68 which is open toward the circumference and, beginning at the end face 16 of the control slide head 68, extends to a point above the control edge 31. As a result, the pressure drop at the circumference of the control slide head 68 is again influenced in such a way that the pressure force in the region of the longitudinal groove 79 is lower, and the control slide head 68 rests on the slide bore 67 in the vicinity of the longitudinal groove 79. In this exemplary embodiment, it is advisable to secure the control slide 14 against twisting, so that the longitudinal groove 79 will not come to overlap one of the control slits 29 under unfavorable conditions.

This may be effected, for instance, by disposing a helical spring 80 in the pressure chamber 39. This spring 80 is then supported at one end on the end face 16 of the control slide 14 and on the other end on the base 81 of a cup-like damping sheath 82, with the base 81 defining the pressure chamber 39 on its side remote from the end face 16 of the control slide 14. The damping sheath 82 is inserted into an appropriate opening 83 in the valve housing 32 and is secured against twisting. The damping throttle opening 38 is provided in the base 81 of the damping sheath 82. The spring end 84 of the helical spring 80 which is oriented toward the base 81 of the damping sheath 82 is bent at an angle relative to the coil of the spring. This spring end 84 is secured on the base 81, preferably being welded or soldered in place. The spring end 85 of the helical spring 80 oriented toward the control slide 14 is also bent relative to the spring coil, preferably in such a manner that it extends parallel to the control slide axis and protrudes into an appropriately embodied aperture 86 of the control slide 14 which is provided eccentrically but extends parallel to the axis of the control slide. The embodiment and disposition of the helical spring 80 thus prevents twisting on the part of the control slide 14.

The helical spring 80 is preferably embodied as relatively non-rigid, having a flat spring characteristic, and its spring force exerted upon the control slide 14 is very small in comparison with the force exerted upon the control slide 14 by the pressure in the pressure chamber 39. When the engine is not in operation, and when after a relatively long period of time the pressure in the lines and component parts of the fuel injection system may have dropped to a pressure which may be lower than atmospheric pressure by the amount of the geodetic pressure difference between the fuel tank 20 and the pressure chamber 39, the spring force of the helical spring 80 is still sufficiently great that it can displace the control slide 14 into its outset position, that is, the position in which the control slits 29 are closed.

In place of the longitudinal groove 79, a channel could also extend from the end face of the control slide head 68 and terminate, in a manner not shown, at a point above the control edge 31 on the circumference of the control slide head 68, so that the control pressure $p_{S_f}$ then prevails at this point and the control slide head 68 rests on this side of the slide bore 67.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A metering and distribution valve assembly for a fuel injection system of an internal combustion engine having a housing; a slotted sleeve in said housing; a control slide with a control edge axially movable in said slotted sleeve; said slotted sleeve including at least two control slits embodied therein which upon relative movement between the control slide and the slotted sleeve said control slits are opened to a greater or lesser degree by the control edge of said control slide; a system pressure valve for regulating a system pressure of fuel engaging the control edge of said control sleeve; said control slide including an end face adjacent said control edge which is exposed to fuel having a control pressure which is lower than the system pressure; at least one control pressure valve for controlling the control pressure; the said control slide including a cylindrical control slide head formed between the control edge and the end face whereby the pressure drops at the circumference of said control slide head is capable of being influenced in such a manner that said control slide head rests on one side against the slotted sleeve at least during a portion of the displacement movement.

2. A metering and distribution valve assembly as defined by claim 1, which includes an aperture that penetrates said slotted sleeve at a position between two control slits in said slotted sleeve on a level with the control slits, which aperture communicates with fuel under system pressure.

3. A metering and distribution valve assembly as defined by claim 1, which includes a longitudinal groove having an upper end 74 and a lower end 75 disposed in the wall of the slide bore of said slotted sleeve between two control slits; said upper end of said longitudinal groove is oriented toward the end face of the control slide and exposed to fuel at control pressure during small opening movements of the control slide, and said lower end of the longitudinal groove is oriented toward the control edge and merges with a transverse groove, which is overlapped by the control edge during small opening movements of the control slide, while during an opening movement which is larger than the said small opening movements, the control edge opens the transverse groove toward the side of the fuel system pressure and the end face overlaps the upper end of the longitudinal groove.

4. A metering and distribution valve assembly as defined by claim 1, which includes means for securing said control slide against twisting; and a channel in said control slide which begins at the end face of the control slide and discharges at the circumference of the control slide above the control edge.

5. A metering and distribution valve assembly as defined by claim 2, in which said control slide has a longitudinal groove opening toward the circumference, which longitudinal groove, beginning at the end face, extends to a point above the control edge.

6. A metering and distribution valve assembly as defined by claim 5, which includes means for securing said control slide against twisting.

* * * * *